US005899145A

United States Patent [19]

Schaede

[11] Patent Number: 5,899,145

[45] Date of Patent: May 4, 1999

[54] INTAGLIO PRINTING PRESS

[75] Inventor: Johannes Georg Schaede, Wurzburg, Germany

[73] Assignee: De La Rue Giori S.A., Lausanne, Switzerland

[21] Appl. No.: 09/046,863

[22] Filed: Mar. 24, 1998

[30] Foreign Application Priority Data

Apr. 14, 1997 [CH] Switzerland ..... 0856/97

[51] Int. Cl.[6] ..... B41F 9/02; B41F 9/08; B41F 9/18

[52] U.S. Cl. ..... 101/152; 101/155

[58] Field of Search ..... 101/152, 153, 101/154, 155, 216, DIG. 35, 136, 137, 140, 247, 349.1, 351.1, 352.01, 174, 175, 182, 184, 185

[56] References Cited

U.S. PATENT DOCUMENTS

| | | | |
|---|---|---|---|
| 4,831,925 | 5/1989 | Bowman et al. | 101/138 |
| 5,186,103 | 2/1993 | Gelinas et al. | 101/181 |
| 5,715,749 | 2/1998 | Miller | 101/216 |

FOREIGN PATENT DOCUMENTS

| | | |
|---|---|---|
| 0091709 | 10/1983 | European Pat. Off. . |
| 0406157 | 1/1991 | European Pat. Off. . |
| 415881 A3 | 3/1991 | European Pat. Off. . |

*Primary Examiner*—J. Reed Fisher

*Attorney, Agent, or Firm*—Kane, Dalsimer, Sullivan, Kurucz, Levy, Eisele and Richard, LLP

[57] ABSTRACT

The intaglio printing machine comprises a main structure (6), a plate cylinder (4), an impression cylinder (3), a wiping device (10) and an inking system consisting of a collector inking cylinder (5), of at least four color-selector cylinders (7*a* to 7*d*), and of an inking device (8*a* to 8*d*) associated with each color-selector cylinder (7*a* to 7*d*) and mounted in a mobile inking carriage (9). The ratio between the diameter of the collector inking cylinder (5) and the diameter of the plate cylinder (4) is equal to 2/3. The two extreme color-selector cylinders (7*a*, 7*d*) are placed so that they are approximately diametrically opposed with respect to the collector inking cylinder (5). The lateral walls of the inking carriage (9), on the same side as the color-selector cylinders, each comprise a recess (15) which is dimensioned in such a way that when the inking carriage (9) is in the working position, the color-selector cylinders (7*b*, 7*c*) which are between said two extreme color-selector cylinders (7*a*, 7*d*) lie wholly in the space defined by said recess (15).

5 Claims, 1 Drawing Sheet

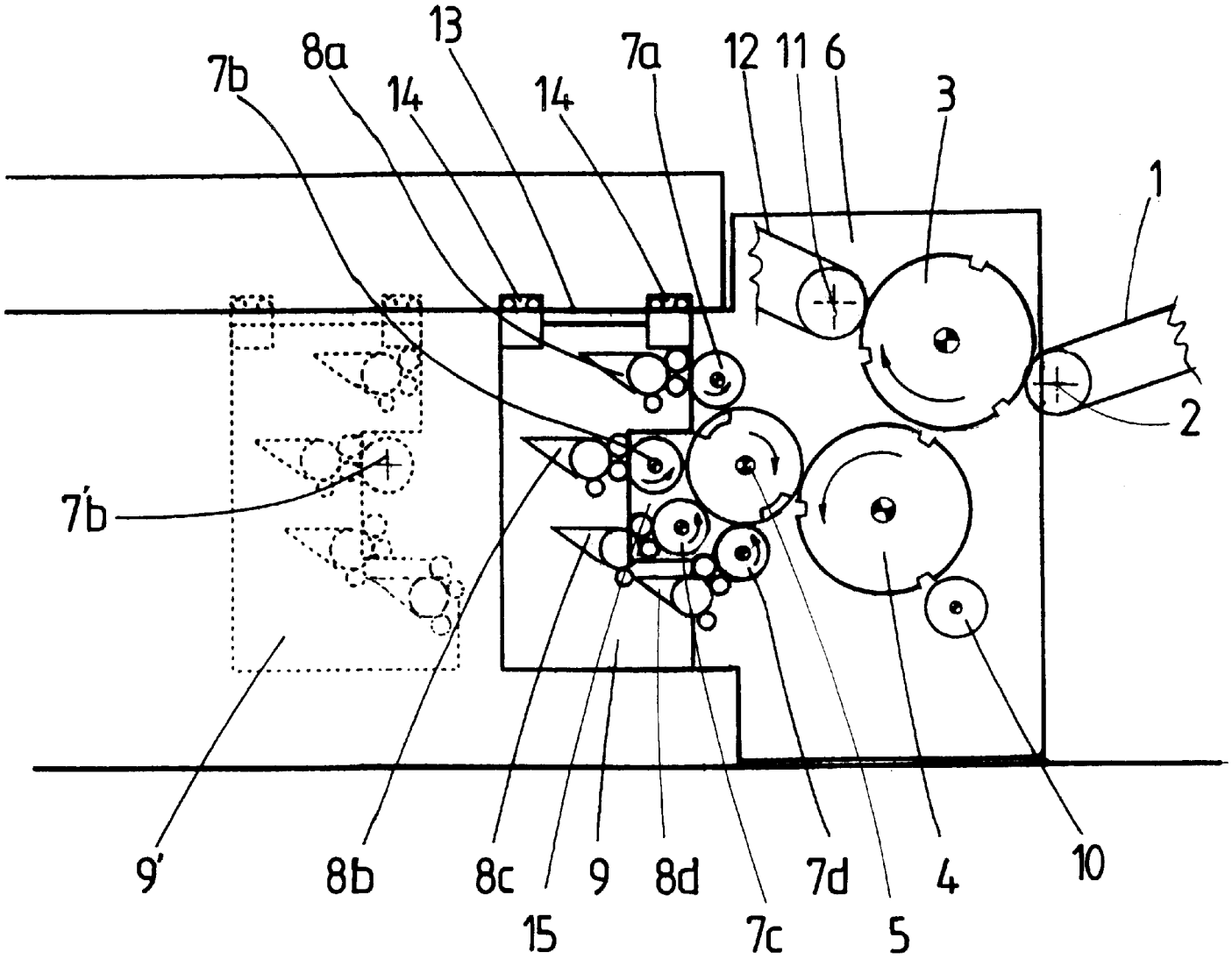
1
2
3
4
5
6
7a
7b
7b'
7c
7d
8a
8b
8c
8d
9
9'
10
11
12
13
14
14
15

INTAGLIO PRINTING PRESS

FIELD OF THE INVENTION

The invention relates to an intaglio printing machine for printing securities, particularly bank notes, comprising a main structure, a plate cylinder with at least one printing plate, an impression cylinder, a wiping device and an inking system consisting of a collector inking cylinder which has an elastic surface interacting with the printing plates, of at least four color-selector cylinders placed one beside the other around part of the circumference of the collector inking cylinder and having reliefs that correspond to the colored regions to be printed in the various colors and in contact with the periphery of the collector inking cylinder, and of an inking device associated with each color-selector cylinder and mounted in a mobile inking carriage.

PRIOR ART

An intaglio printing machine of this kind, for printing securities therefore comprising an indirect inking system that uses a collector inking cylinder is known from the Applicant's patent EP 0 406 157. Thanks to at least four colors, this machine offers the attractive possibility of printing a complete note with a main design and the safety background in a single pass, for example using one color for the main design and three colors for the safety background.

In this known machine, it was thought advantageous, in order to ensure perfect print quality, for the diameter of the collector inking cylinder to be equal to or to represent a multiple of the diameter of the plate cylinder. Now, it has been found that this construction with a collector inking cylinder of the same diameter as the plate cylinder, which as it generally carries three intaglio plates therefore has a relatively large diameter, represents a bulky volume and requires a lot of space; what is more, such a machine is expensive to manufacture and to install, because according to a widely held maxim in the field of printing, installation costs increase as a function of the cube of the diameter of the cylinders used.

SUMMARY OF THE INVENTION

The object of the invention is to create a machine with indirect inking that uses a collector inking cylinder that makes it possible to reduce the costs of manufacturing and building the machine and also allows an appreciable reduction in bulk, while at the same time preserving the advantages of the known machine, namely offering the possibility of printing a complete note with, for example, the main design in one color and the safety background in at least three colors.

For this, the intaglio printing machine according to the invention is one wherein the ratio between the diameter of the collector inking cylinder and the diameter of the plate cylinder is equal to ⅔, wherein the two extreme color-selector cylinders are placed so that they are approximately diametrically opposed with respect to the collector inking cylinder, and wherein the lateral walls of the inking carriage, on the same side as the color-selector cylinders, each comprise a recess which is dimensioned in such a way that when the inking carriage is in the working position, the color-selector cylinders which are between said two extreme color-selector cylinders lie wholly in the space defined by said recess.

It was possible to check that the print quality obtained with a machine according to the invention is practically the same as that obtained with the earlier machine where the ratio between the collector inking cylinder and the plate cylinder is equal to 1/1; good results are thus obtained with a smaller collector inking cylinder.

Admittedly, said ratio of ⅔ between the diameters of the two cylinders is already known from another printing machine described in patent EP 0 091 709 by the Applicant, but this machine is of a different type because it has a direct inking device for printing the main design and an indirect inking device using a collector inking cylinder for printing the safety background. In any case, this machine would have only three inking devices associated with the collector inking cylinder, because it was thought impossible to place more than three inking systems around the collector inking cylinder.

Advantageously, the machine according to the present invention is equipped with an inking carriage which runs not on the ground but which is, according to the characteristics of claim 4, suspended from guide rails, this avoiding the costly installation of guide rails on the ground.

Other characteristics of the invention stem from the dependent claims.

The invention will be described by way of non-limiting example with reference to the appended drawing, the single FIGURE of which diagrammatically depicts a sheet-fed intaglio printing machine produced in accordance with the present invention.

The machine depicted comprises an impression cylinder 3 interacting with a plate cylinder 4, these two cylinders having the same diameter, and a collector inking cylinder 5 in contact with the plate cylinder 4. The ratio between the diameter of the collector inking cylinder 5 and the diameter of the plate cylinder 4 is equal to ⅔. The plate cylinder 4 is fitted with a number of engraved printing plates which are uniformly distributed around its periphery. In this instance, the plate cylinder 4 carries three printing plates. The impression cylinder 3 therefore carries three blankets and the collector inking cylinder 5 also has three blankets. Along part of the periphery of the collector inking cylinder 5 which has an elastic surface, there are mounted four color-selector cylinders 7*a* to 7*d*, each associated with an inking device 8*a* to 8*d* which inks the corresponding color-selector cylinder. The diameter of the color-selector cylinders is equal to ⅓ of the plate cylinder 4.

The four color-selector cylinders 7*a* to 7*d* have a surface made of a hard material and each selector cylinder has regions in relief, the contours of which correspond exactly to those of the surfaces to be printed in the respective color. This being the case, the hard surface of the reliefs of the selector cylinders interacts with the elastic surface of the collector cylinder.

The direction of rotation of the various cylinders is depicted by arrows in the drawing. The impression cylinder 3, the plate cylinder 4, the collector inking cylinder 5 and the color-selector cylinders 7*a* to 7*d* are installed in the main structure 6, while the inking devices 8*a* to 8*d* are installed in a mobile inking carriage 9. The color-selector cylinders 7*a* to 7*d* can also be installed in an independent intermediate carriage.

A wiping device 10 is also provided at the periphery of the plate cylinder 4, and comes after the collector inking cylinder 5 in the direction of rotation; this cylinder cleans the surface of the engraved plates away from the intaglio cuts and pushes the ink into said cuts.

Paper in sheet form is fed to the machine by a sheet feed device 1 and a transfer cylinder 2 which hands the sheets to the impression cylinder 3. The paper, held on this cylinder by grippers, passes between this cylinder and the plate cylinder 4, where it is printed. It is then transported by another transfer cylinder 11 onto a transport device 12.

BRIEF DESCRIPTION OF THE DRAWINGS

As depicted in the drawing, the layout of the machine is such that the line connecting the axes of the impression cylinder 3 and of the plate cylinder 4 is perpendicular to the line connecting the axes of the plate cylinder 4 and of the collector inking cylinder 5 and such that the impression cylinder 3 is located at least approximately vertically above the plate cylinder 4. In this way, any possible flexing by a few fractions of a millimeter of the plate cylinder 4 which could occur on account of the high pressure needed in intaglio printing would not interfere with the collector inking cylinder 5 in any way.

As can be seen in the drawing, the layout of the color-selector cylinders 7*a* to 7*d* around the collector inking cylinder 5 is such that the two extreme selector cylinders, that is to say the uppermost selector cylinder 7*a* and the lowermost selector cylinder 7*d,* are placed so that they are approxiamtely diametrically opposed. Furthermore, the lateral walls of the inking carriage 9, on the same side as the color-selector cylinders 7, each comprise a recess 15 the size of which is such that when the inking carriage 9 is in the working position, that is to say when the color-selector cylinders 7*a* to 7*d* are in contact with the collector inking cylinder 5, the intermediate color-selector cylinders 7*b,* 7*c* are situated wholly in the space defined by said recess 15.

With the arrangement just described, the best possible use is made of the available space and enough space is freed up for at least four color-selector cylinders to be installed.

DESCRIPTION OF THE PREFERRED EMBODIMENT

According to the embodiment depicted, this mobile inking carriage 9 runs not on the ground but is suspended from upper guide rails 13 via rollers 14. All the inking devices 8*a,* 8*b,* 8*c,* 8*d* are therefore installed in the mobile carriage 9 which, thanks to the rollers 14, can run along these rails 13 in its position of rest away from the main structure 6. This position is illustrated in dotted line in the FIGURE. Through this approach of suspending the inking carriage, the floor space in the machine room is freed of the guide rails which hitherto had to be fixed to the ground or formed by grooves set into the ground. Thus the floor of the machine room is free of any obstacles and all the costs inherent in installing and anchoring guide rails into the ground are avoided.

Furthermore, thanks to it being suspended, the inking carriage 9 can be moved more easily and can also be adjusted more simply and more swiftly in its working position.

To facilitate access to the collector inking cylinder 5 when the inking carriage 9 is moved away from the collector inking cylinder 5, at least one of the two intermediate color-selector cylinders, in the embodiment depicted this is the upper intermediate cylinder 7*b,* is attached to the main structure 6 of the machine by means of a quick coupling system so that it can readily be detached therefrom and reattached directly and quickly to the inking carriage 9 while the latter is still in the working position. This change of attachment can therefore be carried out without moving the selector cylinder 7*b.* Using this approach, when the inking carriage 9 is moved away from the main structure, as illustrated in dotted line in the FIGURE, the intermediate selector cylinder 7'*b* is also moved, which allows easier access to the collector inking cylinder 5 so that it can be cleaned more easily.

To print a complete note, use is made of printing plates on which there are etched both the main design to be printed in one color, formed of relatively deep intaglio cuts of varying sizes, and the safety background, to be printed in three colors, and which is formed of very fine intaglio cuts consisting mainly of very fine lines or of dots which are shallower than those that make up the main design.

The invention is not restricted to the embodiment just described, particularly as regards the form of the mobile carriage with its recesses which could be produced differently.

I claim:

1. An intaglio printing machine for printing securities, particularly bank notes, comprising a main structure (6), a plate cylinder (4) with at least one printing plate, an impression cylinder (3), a wiping device (10) and an inking system consisting of a collector inking cylinder (5) which has an elastic surface interacting with the printing plates, of at least four color-selector cylinders (7*a* to 7*d*) placed one beside the other around part of the circumference of the collector inking cylinder (5) and having reliefs that correspond to the colored regions to be printed in the various colors and in contact with the periphery of the collector inking cylinder (5), and of an inking device (8*a* to 8*d*) associated with each color-selector cylinder (7*a* to 7*d*) and mounted in a mobile inking carriage (9), wherein the ratio between the diameter of the collector inking cylinder (5) and the diameter of the plate cylinder (4) is equal to ⅔; wherein the two extreme color-selector cylinders (7*a,* 7*d*) are placed so that they are approximately diametrically opposed with respect to the collector inking cylinder (5), and wherein the lateral walls of the inking carriage (9), on the same side as the color-selector cylinders, each comprise a recess (15) which is dimensioned in such a way that when the inking carriage (9) is in the working position, the color-selector cylinders (7*b,* 7*c*) which are between said two extreme color-selector cylinders (7*a,* 7*d*) lie wholly in the space defined by said recess (15).

2. The machine as claimed in claim 1, wherein the color-selector cylinders (7*a* to 7*d*) are mounted on the main structure (6).

3. The machine as claimed in claim 1, wherein the color-selector cylinders (7*a* to 7*d*) are mounted in an independent intermediate carriage.

4. The machine as claimed in claim 1, wherein the inking carriage (9) is suspended from the machine by guide rails (13).

5. The machine as claimed in claim 1, wherein at least one (7*b*) of the color-selector cylinders (7) which are between the extreme color-selector cylinders is attached to the main structure (6) by a readily detachable quick coupling so that when the inking carriage (9) is in the working position, it can be detached from the main structure (6) and attached to the inking carriage so that when this inking carriage is moved away from the main structure, access to the collector inking cylinder (5) becomes easier.

* * * * *